US009035571B2

(12) United States Patent
Erhardt et al.

(10) Patent No.: US 9,035,571 B2
(45) Date of Patent: May 19, 2015

(54) ELECTRONIC BALLAST WITH DIMMING CIRCUIT

(75) Inventors: Robert A. Erhardt, Schaumburg, IL (US); William Lawrence Keith, Lake in the Hills, IL (US); Raman Nair Harish Gopala Pillai, Mt. Prospect, IL (US); Jerzy Janczak, Libertyville, IL (US); Ningliang Mi, Arlington Heights, IL (US); Srinivasa Baddela, Streamwood, IL (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 547 days.

(21) Appl. No.: 13/496,651

(22) PCT Filed: Sep. 3, 2010

(86) PCT No.: PCT/IB2010/053977

§ 371 (c)(1),
(2), (4) Date: Apr. 25, 2012

(87) PCT Pub. No.: WO2011/033412

PCT Pub. Date: Mar. 24, 2011

(65) Prior Publication Data

US 2012/0200232 A1 Aug. 9, 2012

Related U.S. Application Data

(60) Provisional application No. 61/243,744, filed on Sep. 18, 2009.

(51) Int. Cl.
*G05F 1/00* (2006.01)
*H05B 41/392* (2006.01)

(52) U.S. Cl.
CPC ..... *H05B 41/3921* (2013.01)

(58) Field of Classification Search
CPC ..... H05B 37/02; H05B 33/08; Y02B 70/10
USPC ..... 315/291, 294, 308, 307, 246, 247, 312
See application file for complete search history.

(56) References Cited

U.S. PATENT DOCUMENTS 5,455,486 A 10/1995 Tobler
6,265,830 B1 * 7/2001 Bretmersky et al. ..... 315/106

(Continued)

FOREIGN PATENT DOCUMENTS

CN 101420802 A 4/2009
DE 19842761 A1 3/2000

(Continued)

*Primary Examiner* — Minh D A

(57) ABSTRACT

An electronic ballast with dimming circuit including an electronic ballast dimming circuit receiving an analog dimming signal, the electronic ballast dimming circuit including an input dimming circuit (210) operable to receive the analog dimming signal (252) at an analog dimming signal input (212); and an output dimming circuit (220) operably connected to the input dimming circuit (210), the output dimming circuit (220) being operable to receive a fixed frequency signal (222) having a variable duty cycle and to generate an analog dimming control signal (224) in response to the analog dimming signal (252). Output voltage at the analog dimming signal input (212) is a function of the variable duty cycle of the fixed frequency signal (222) when the analog dimming signal (252) is not present at the analog dimming signal input (212).

22 Claims, 4 Drawing Sheets

(56) References Cited

U.S. PATENT DOCUMENTS

| | | | | |
|---|---|---|---|---|
| 6,300,719 | B1 | 10/2001 | Tlaga | |
| 6,339,299 | B1 | 1/2002 | Wu | |
| 6,359,387 | B1 | 3/2002 | Giannopoulos | |
| 6,407,515 | B1 * | 6/2002 | Hesler et al. | 315/294 |
| 6,501,235 | B2 | 12/2002 | Ortmeyer | |
| 6,977,642 | B2 | 12/2005 | Nagatani | |
| 7,368,916 | B2 | 5/2008 | Waymouth | |
| 2005/0067973 | A1 | 3/2005 | Beij | |
| 2005/0067980 | A1 | 3/2005 | Krummel | |
| 2009/0096391 | A1 * | 4/2009 | Notohamiprodjo et al. | 315/307 |
| 2009/0302779 | A1 * | 12/2009 | McKinney | 315/294 |

FOREIGN PATENT DOCUMENTS

| | | | |
|---|---|---|---|
| DE | 202006000449 | U1 | 4/2006 |
| JP | 7142175 | A | 6/1995 |
| JP | 7272881 | A | 10/1995 |
| JP | 2001185393 | A | 7/2001 |
| JP | 2003133087 | A | 5/2003 |
| JP | 2009032521 | A | 2/2009 |
| WO | 0189271 | A1 | 11/2001 |

* cited by examiner

ELECTRONIC BALLAST WITH DIMMING CIRCUIT

The technical field of this disclosure is power supplies, particularly, an electronic ballast with dimming circuit.

Electronic ballasts can be used to provide high frequency AC power to light fluorescent lamps. Electronic ballasts commonly perform a number of power-related functions including, inter alia, the conversion of power from the primary sources to AC voltages and frequencies corresponding to the requirements of respective lamps, and the limiting and control of the flow of electrical current to the lamps. Dimming circuits can be provided in the electronic ballasts to allow the user to manually or automatically dim the lamps to a desired brightness. Unfortunately, dimming circuits present a number of problems.

Obtaining information from a lighting system to check ballast and lamp operation, such as fault conditions and/or lamp life, is very valuable for troubleshooting and maintenance. Unfortunately, dimming circuits for analog dimming signals, e.g., for dimming signals operating at 0-10 Volts DC, only permit information to flow from the dimmer to the electronic ballast and not vice versa. The ballast lead wires that carry the analog dimming signals offer an accessible port to the electronic ballast, but present dimming circuits can only receive signals from the ballast lead wires. Present electronic ballasts require dedicated communication circuits or more complex digital communication schemes, such as the DALI protocol, to transmit information from the electronic ballast. This increases the size, complexity, and cost of the electronic ballasts.

Other problems with dimming circuits for electronic ballasts include efficiency and lamp lifetime. Dimming combined with daylight harvesting can provide as much as 40 percent energy savings or more when compared with static systems. Unfortunately, Dimming system efficiency falls off as lamps are dimmed and lamp lifetime can suffer. One approach to dimming ballasts for daylight harvesting has been to instantaneously switch off sets of lamps as light demand decreases, i.e., as more daylight becomes available. However, the switching off results in a perception by the occupants that something is wrong with the lighting and creates an undesirable distraction. Another approach has been to continuously dim the lamps as light demand decreases, but lamps can only be dimmed to a minimum lighting level, such as 5 percent, and the lamps are much less efficient at minimum light output compared to full light output.

Yet another problem with dimming circuits for electronic ballasts is maintaining proper filament heating. To realize their rated life, lamps must have proper filament heating at all times, including when the lamp is dimmed. Improper filament heating can waste energy and/or reduce lamp life by stressing the cathode and depositing cathode material on the glass bulb. Insufficient filament heating also can result in loss of lamp discharge as lamp current is reduced. Presently, standardized filament heating limits, which are the result of a compromise between the optimal requirements for different manufacturers' lamps, are used in electronic ballasts. This results in some lamps running with overly cold filaments (reducing lamp life) and other lamps running with overly hot filaments (reducing lamp life and wasting energy).

It would be desirable to have an electronic ballast with dimming circuit that would overcome the above disadvantages.

One aspect of the present invention provides an electronic ballast dimming circuit receiving an analog dimming signal, the electronic ballast dimming circuit including an input dimming circuit operable to receive the analog dimming signal at an analog dimming signal input; and an output dimming circuit operably connected to the input dimming circuit, the output dimming circuit being operable to receive a fixed frequency signal having a variable duty cycle and to generate an analog dimming control signal in response to the analog dimming signal. Output voltage at the analog dimming signal input is a function of the variable duty cycle of the fixed frequency signal when the analog dimming signal is not present at the analog dimming signal input.

Another aspect of the present invention provides an electronic ballast operably connected to a first lamp and a second lamp, the electronic ballast including a control circuit operable to receive a dimming signal and to generate a power converter control signal; and a power converter operable to receive the power converter control signal and to provide first lamp power to the first lamp and second lamp power to the second lamp. When the dimming signal is greater than a predetermined dimming signal, the power converter controls the first lamp power between a minimum first lamp power and a maximum first lamp power in response to the dimming signal, and the power converter sets the second lamp power to off. When the dimming signal is less than the predetermined dimming signal, the power converter controls the first lamp power between an intermediate first lamp power and the maximum first lamp power in response to the dimming signal, and the dimming control signal controls the second lamp power between an intermediate second lamp power and a maximum second lamp power in response to the dimming signal.

Another aspect of the present invention provides an electronic ballast operably connected to a lamp having a lamp filament, the electronic ballast including a microcontroller operable to receive a command signal and to generate a power converter control signal; a memory operably connected to the microcontroller, the memory being operable to store a plurality of filament heating profiles; and a power converter responsive to the power converter control signal to provide filament power to the lamp filament. The microcontroller selects one of the plurality of filament heating profiles from the memory and controls the power converter control signal in accordance with the selected one of the plurality of filament heating profiles.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

FIG. 1 is a block diagram of an electronic ballast in accordance with the present invention. The electronic ballast is dimmable so that lamp light output can be set as desired for a particular application.

Figure 1:
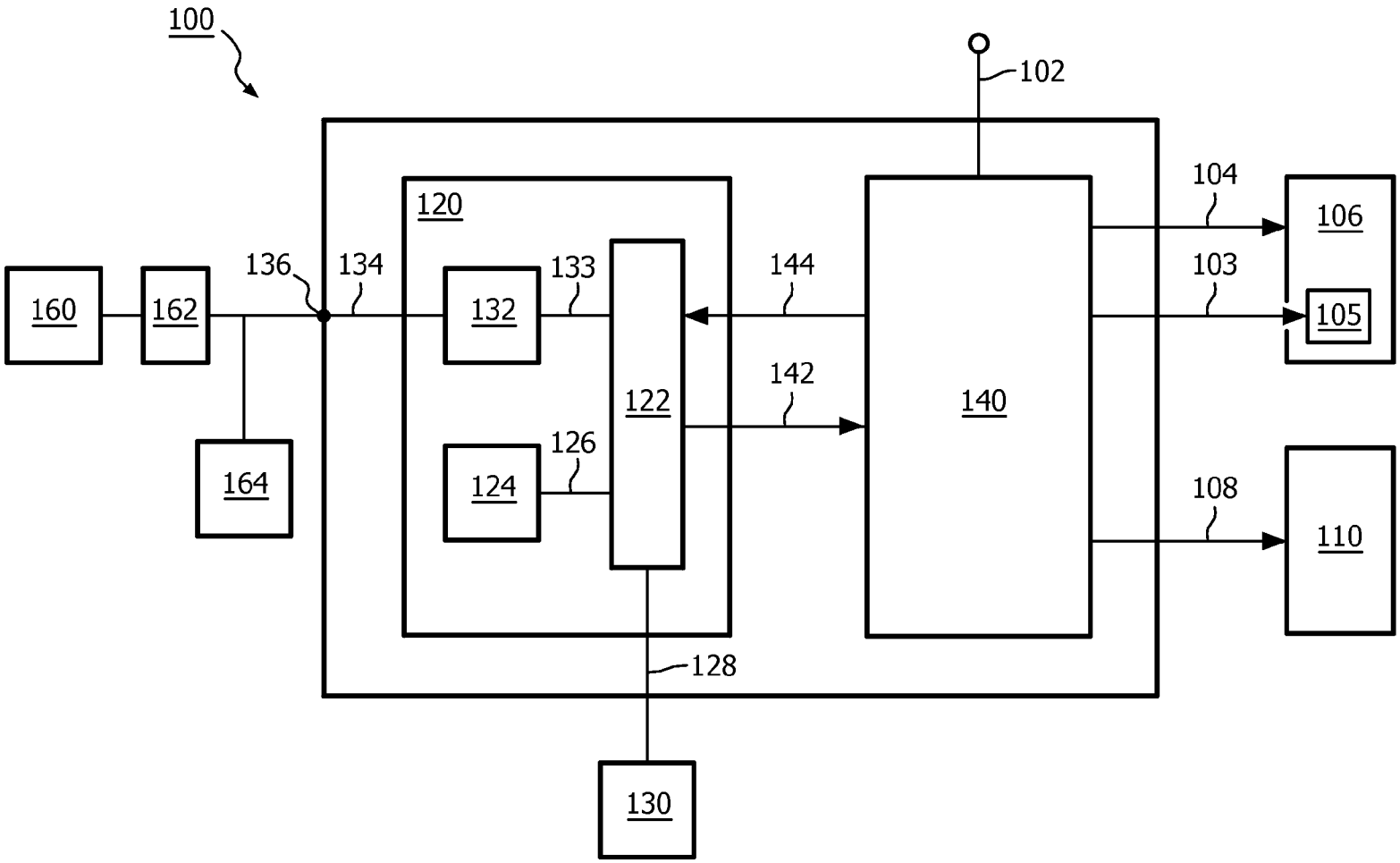
FIG. 1 is a block diagram of an electronic ballast in accordance with the present invention.

Electronic ballast 100 receives mains power 102 and provides lamp power 104 to lamp 106. In one embodiment, the electronic ballast 100 also provides lamp power 108 to optional lamp 110. The electronic ballast 100 includes a control circuit 120 and a power converter 140.

The power converter 140 receives mains power 102 and provides lamp power 104, 108 responsive to power converter control signal 142 from the control circuit 120. The power converter 140 can also provide filament power 103 to lamp filament 105 of the lamp 106 in response to the power converter control signal 142. The power converter 140 can provide power converter information signal 144 to the control circuit 120. The power converter information signal 144 can include information on the lamps 106, 110 and the power converter 140 for use in operation and maintenance of the electronic ballast 100. In one embodiment, the power converter information signal 144 includes fault information for the lamps 106, 110 and the power converter 140.

The control circuit 120 can include a microcontroller 122 and a memory 124 operably connected to the microcontroller 122 by link 126. In one embodiment, the memory 124 is internal to the microcontroller 122. The memory 124 can be used to store information for operation of the electronic ballast 100, such as filament heating profiles.

The dimming of the lamps 106, 110 can be provided through an analog input, a digital input, or other suitable dimming input. In one embodiment, the microcontroller 122 of the control circuit 120 is responsive to a communication signal 128 operably connected to a lighting control system 130. The communication signal 128 can conform to wired control schemes, such as a DALI protocol, a DMX protocol, or the like, or to wireless control schemes, such as a Zigbee protocol or the like. The communication signal 128 can control dimming of the lamps 106, 110 through the control circuit 120 and the power converter 140. In another embodiment, the control circuit 120 includes a dimming circuit 132 which provides a dimming control signal 133 to the microcontroller 122. The dimming signal 134 can be a 0-10 Volt analog signal. The electronic ballast 100 receives the dimming signal 134 at dimming signal input 136 from ballast lead wires operably connected to a dimmer 160. A switch 162 and sensor 164 can optionally be included between the dimmer 160 and the dimming signal input 136 when the dimming signal input 136 is also used as an electronic ballast information output. The switch 162 can disconnect the dimmer 160 from the electronic ballast 100 and the sensor 164 can read the output voltage at the dimming signal input 136.

The electronic ballast can store a number of filament heating profiles, such as default, lamp life, and/or efficiency filament heating profiles. The filament heating profile specifies the filament current used during operation at different dimming levels. In one embodiment, the electronic ballast is operably connected to a lamp having a lamp filament. The electronic ballast includes a microcontroller 122, a memory 124, and a power converter 140. The microcontroller 122 is operable to receive a communication signal 128 and to generate a power converter control signal 142. The memory 124 is operably connected to the microcontroller 122 and is operable to store a number of filament heating profiles. The power converter 140 is responsive to the power converter control signal 142 to provide filament power 103 to the lamp filament 105.

In operation, the microcontroller 122 selects one of the filament heating profiles from the memory and controls the power converter control signal in accordance with the selected one of the number of filament heating profiles. In one embodiment, the microcontroller 122 selects one of the filament heating profiles in response to a communication signal 128 from a lighting control system 130. The microcontroller can select the default filament heating profile each time the microcontroller powers up or can select the most recently used filament heating profile each time the microcontroller powers up.

The several filament heating profiles can be suitable for different lamps and different operating goals. The microcontroller 122 can select a default filament heating profile absent any other instructions directing the microcontroller 122 to select a particular filament heating profile. The default filament heating profile can be based on standardized filament heating requirements for a number of different manufacturers' lamps. The lamp life filament heating profile can be based on a filament heating profile that provides the longest life for a particular lamp, such as by providing a filament current that prevents the filament from running too cold or too hot. The efficiency filament heating profile can be based on a filament heating profile that provides the greatest efficiency, such as by providing a filament current that prevents the filament from running too hot.

Figure 2:
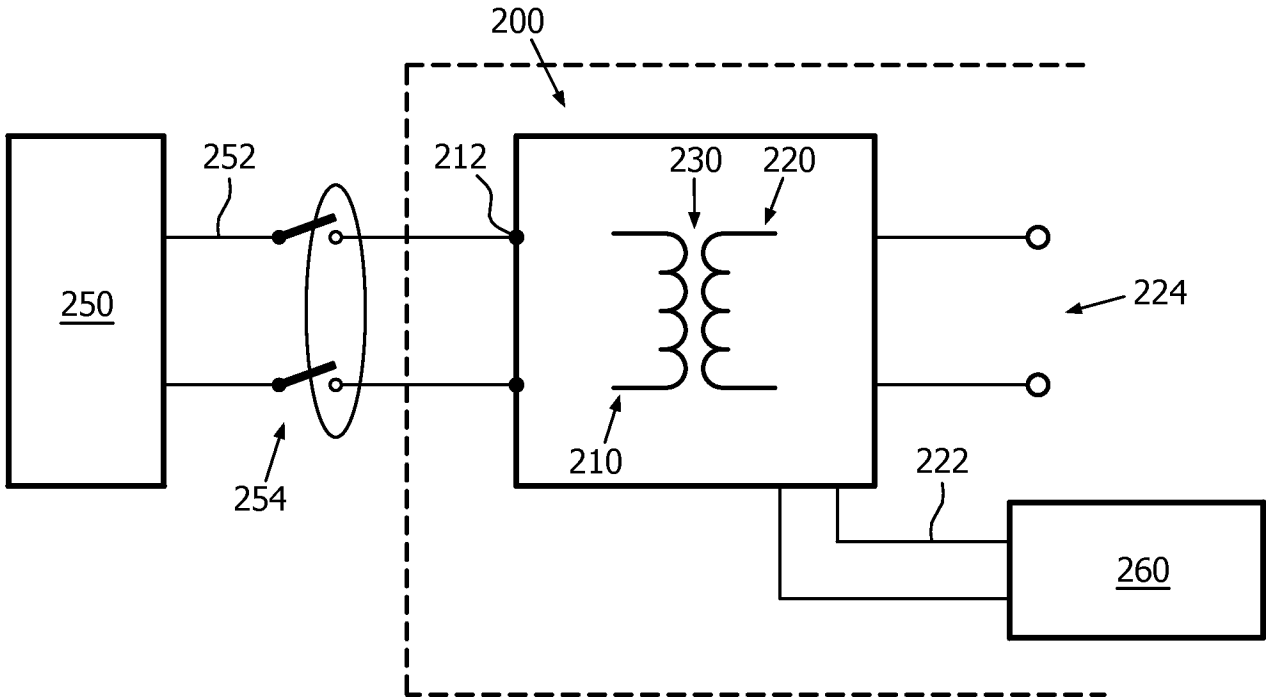
FIG. 2 is a block diagram of a dimming circuit of an electronic ballast in accordance with the present invention.

FIG. 2 is a block diagram of a dimming circuit of an electronic ballast in accordance with the present invention. In this example, the dimming circuit acts both as an input for an analog dimming signal to the electronic ballast and as an output for electronic ballast information. The electronic ballast information can include information on the lamp and/or electronic ballast, such as faults, maintenance parameters, or the like.

The dimming circuit 200 for the electronic ballast includes an input dimming circuit 210 and an output dimming circuit 220 operably connected to the input dimming circuit 210. In this example, the output dimming circuit 220 is operably connected to the input dimming circuit 210 through an isolation transformer 230. The input dimming circuit 210 receives an analog dimming signal 252 at an analog dimming signal input 212 from dimmer 250 when switch 254 is closed. In one embodiment, the analog dimming signal 252 from the dimmer 250 is 0-10 Volts DC. The output dimming circuit 220 is operable to receive a fixed frequency signal 222 having a variable duty cycle and to generate an analog dimming control signal 224 in response to the analog dimming signal 252. In one embodiment, a microcontroller 260 provides the fixed frequency signal 222. In one embodiment, the analog dimming control signal 224 is 0-5 Volts DC. When the switch 254 is open so that the analog dimming signal 252 is not present at the analog dimming signal input 212, the output voltage at the analog dimming signal input 212 is a function of the variable duty cycle of the fixed frequency signal 222. Thus, the duty cycle of the fixed frequency signal 222 can be varied to provide information from the electronic ballast through the ballast lead wires, reversing the usual information flow from the dimmer to the electronic ballast. In one embodiment, the fixed frequency signal 222 is a 0-5 Volt square wave with a variable duty cycle and a fixed frequency of about 30 kHz.

The analog dimming signal input 212 can be encoded to indicate different faults and/or operating conditions in the electronic ballast and lamps. In one embodiment, the output voltage at the analog dimming signal input 212 is broken into discrete voltage levels with each discrete voltage level corresponding to particular electronic ballast information such as a particular fault or operating condition, e.g., 1 Volt indicating Fault 1, 2 Volts indicating Fault 2, et cetera. In another embodiment, the output voltage at the analog dimming signal input 212 is a serial string of information that can be decoded to indicate electronic ballast information such as a particular fault or operating condition, e.g., 1 Volt followed by 2 Volts followed by 1 Volt can indicate Fault 1. Those skilled in the art will appreciate that the encoding can be selected as desired for a particular application.

Figure 3:
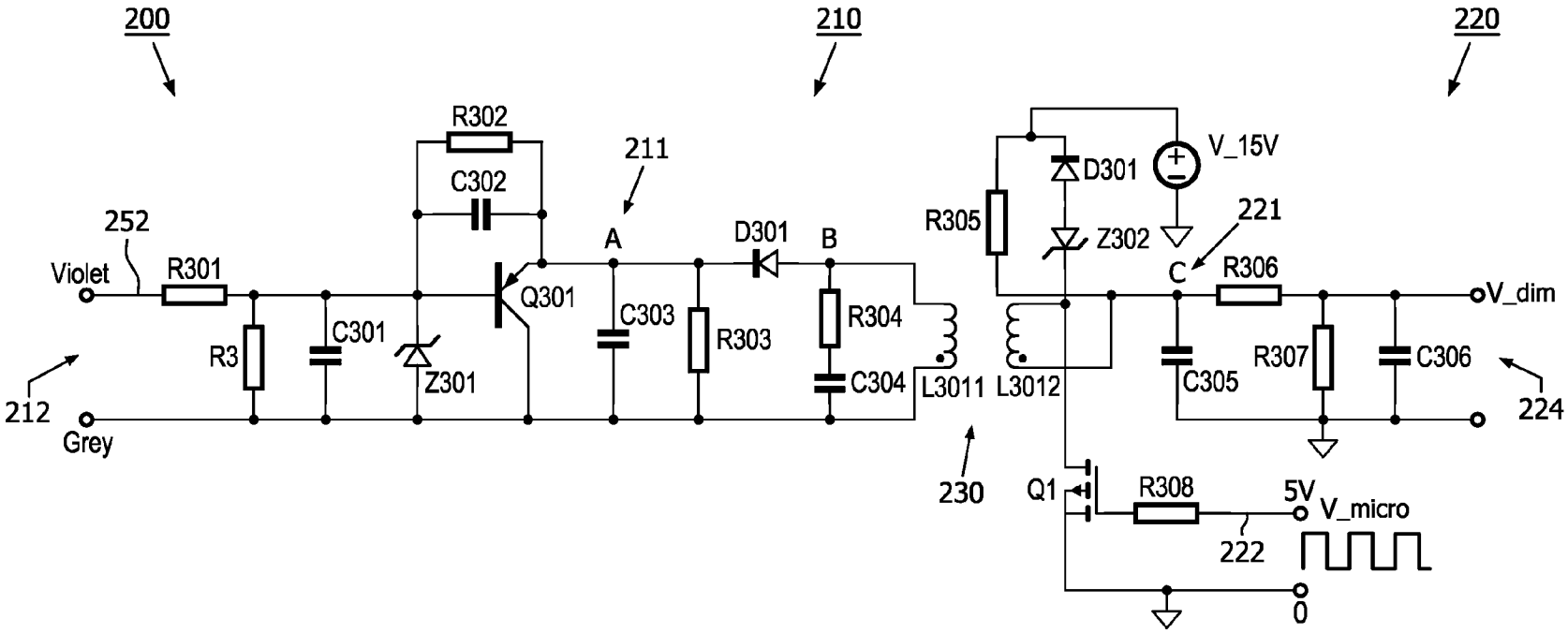
FIG. 3 is a schematic diagram of a dimming circuit of an electronic ballast in accordance with the present invention.

FIG. 3, in which like elements share like reference numbers with FIG. 2, is a schematic diagram of a dimming circuit of an electronic ballast in accordance with the present invention. When the dimmer is connected to the dimming circuit, the duty cycle of the fixed frequency signal is constant and varying the analog dimming signal varies the analog dimming control signal, which sets the lamp output. When the dimmer is not connected to the dimming circuit, varying the duty cycle of the fixed frequency signal varies the voltage output at the analog dimming signal input, which transmits information from the electronic ballast outward through the ballast lead wires.

When the dimmer (not shown) is connected to the analog dimming signal input 212, the analog dimming control signal 224 controls dimming of the lamps. The dimmer connected across the analog dimming signal input 212 can be a variable voltage source, such as a variable voltage source providing 0-10 Volts DC, or a variable impedance, such as a variable impedance providing 0-500 kOhms. The transformer 230 with primary winding L3012 and secondary winding L3011 provides isolation between the input dimming circuit 210 and an output dimming circuit 220.

In the input dimming circuit 210, resistor R301 is a protective device used to limit input current in the event of miswiring the electronic ballast to line voltage. The resistor R301 can be a positive temperature coefficient (PTC) resistor. Capacitor C301 is a filter capacitor and resistor R3 functions as a discharge resistor. Zener diode Z301 is used to limit the analog dimming signal 252 to a predetermined maximum voltage, such as 10 Volts. The combination of switch Q301, resistor R302 and capacitor C302 forms a buffer amplifier, so that the voltage at 211 closely follows the voltage of the analog dimming signal 252 at the analog dimming signal input 212.

In the output dimming circuit 220, the primary winding L3012 and secondary winding L3011 of transformer 230, switch Q1, diode D301 and capacitor C303 form a flyback converter. In one embodiment, the switch Q1 is a MOSFET. Capacitor C305 is used to average the inherent square wave at 221. Zener diode Z302 and diode D302 limit the reverse voltage across the primary winding L3012 when switch Q1 is switched OFF. Resistors R306 and R307 form a resistive divider to scale down the voltage at 221 and capacitor C306 functions as a filter capacitor.

In operation, when switch Q1 is switched ON, the primary winding L3012 is magnetized with the current through the primary winding L3012 limited by resistor R305. When switch Q1 is switched OFF, the demagnetizing current in the secondary winding L3011 flows through diode D301 and charges capacitor C303. During the ON cycle of the switch Q1, the capacitor C303 discharges through resistor R302 and the collector of switch Q301. Due to the high current gain of transistor switch Q301, the base current of transistor switch Q301 flows through resistor R301 and to the analog dimming signal input 212. The base current of transistor switch Q301 is a fraction (e.g., 1/100) of the collector current of transistor switch Q301. Therefore, the current flowing through the primary winding L3012 is a function of the input voltage or input impedance at the analog dimming signal input 212: the higher the input voltage or impedance, the lower the current that flows through the primary winding L3012 and the voltage drop across resistor R305. For a given duty cycle of the fixed frequency signal 222, the average voltage at 221 controlling lamp dimming through the analog dimming control signal 224 is a function of the analog dimming signal 252.

When the dimmer (not shown) is not connected to the analog dimming signal input 212, varying the duty cycle of the fixed frequency signal 222 varies the voltage output at the analog dimming signal input 212, which transmits information from the electronic ballast outwardly through the ballast lead wires. The components of the dimming circuit 200 are described above.

Varying the duty cycle of switch Q1 changes the charge and discharge times of capacitor C303, changing the voltage across the analog dimming signal input 212. Consequently, the voltage at the analog dimming signal input 212 varies as a function of the duty cycle of switch Q1. The duty cycle of switch Q1 can be set to a particular value to provide a particular voltage at the analog dimming signal input 212 or can be modulated to generate a serially encoded string of voltages at the analog dimming signal input 212. In one embodiment, a microcontroller or microprocessor is used to change the duty cycle of the fixed frequency signal 222 and represent the information to be transmitted. In another embodiment, the duty cycle of the fixed frequency signal 222 can be changed by discrete semiconductor components, such as timers, PWM integrated circuits, or the like. Those skilled in the art will appreciate that the information from the electronic ballast can be presented at the analog dimming signal input 212 in analog or digital form.

The use of the dimming circuit 200 to transmit information from the electronic ballast can be used during fault or non-fault operating conditions. For non-fault operating conditions, the analog dimming control signal 224 is ignored by the electronic ballast logic, such as by blocking the signal at the microcontroller.

Figure 4:
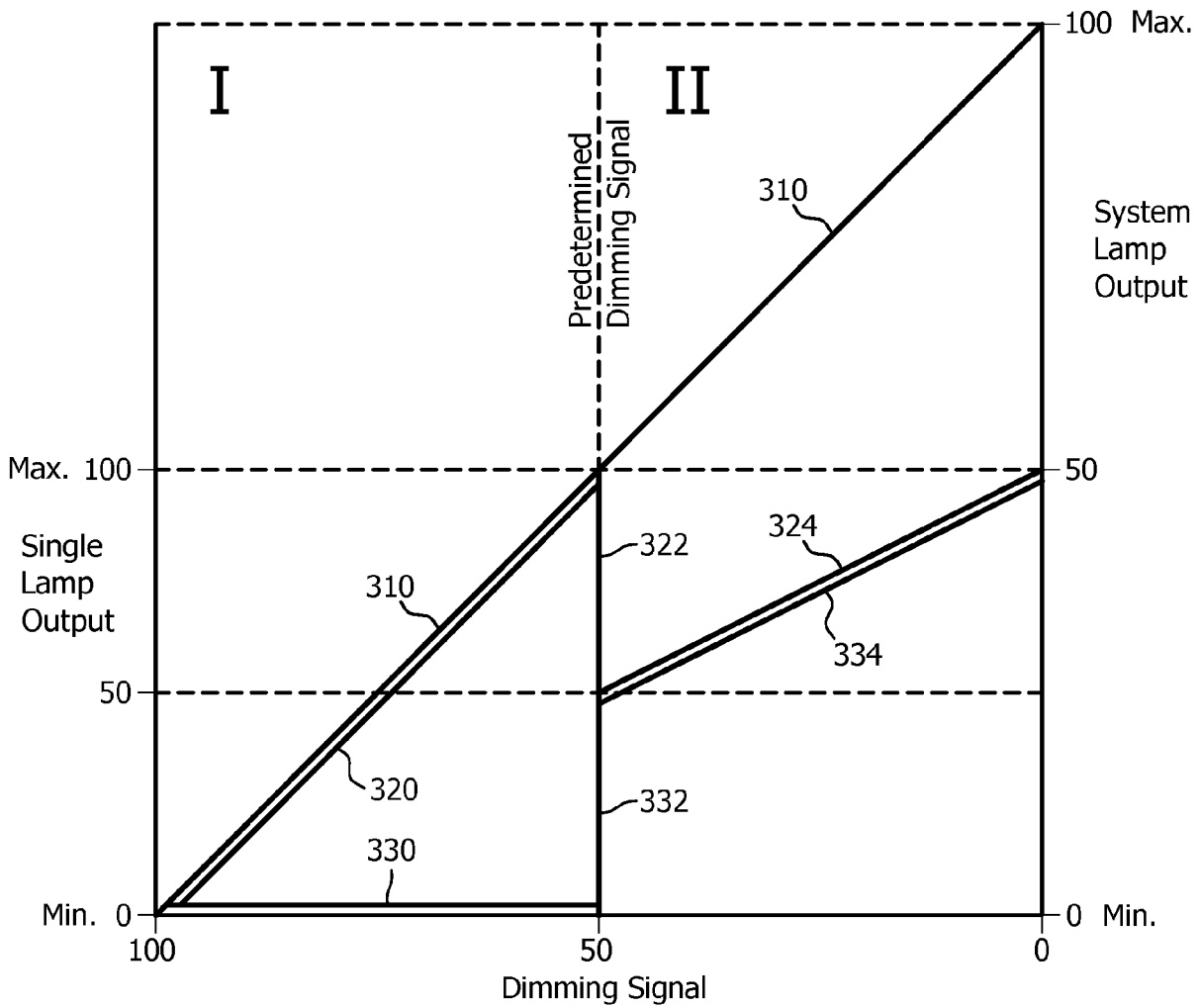
FIG. 4 is a graph of lamp output versus dimming setpoint for an electronic ballast in accordance with the present invention.

FIG. 4 is a graph of lamp output versus dimming setpoint for an electronic ballast in accordance with the present invention. In this example, the lighting system includes two lamps which are complementarily dimmed. Referring to FIG. 1, the electronic ballast 100 is operably connected to a first lamp 106 and a second lamp 110, and includes a control circuit 120 operable to receive a dimming signal 134 and to generate a power converter control signal 142, and a power converter 140 operable to receive the power converter control signal 142 and to provide first lamp power 104 to the first lamp 106 and second lamp power 108 to the second lamp 110. Those skilled in the art will appreciate that the lighting system can use different configurations as desired for a particular application. In one embodiment, each of the first lamp and the second lamp are powered from their own dedicated ballast. In another embodiment, each of the lamps includes a number of individual lamps.

Referring to FIG. 4, single lamp output (first lamp output or second lamp output) is on the left vertical axis and system lamp output (first lamp output plus second lamp output) is on the right vertical axis. The dimming signal is on the horizontal axis, with 100 percent dimming signal (lamps fully dimmed) on the left and zero percent dimming signal on the right (lamps fully on). Thus, the dimming signal is greater toward the left and the dimming signal increases toward the left. System lamp output trace 310 illustrates the system lamp output. First lamp trace 320, 322, 324 illustrates the first lamp output and second lamp trace 330, 332, 334 illustrates the second lamp output.

In this example, the first lamp and the second lamp have the same light output, so the maximum system light output is twice the maximum individual lamp power and the intermediate individual lamp power is one half the maximum individual lamp power. The predetermined dimming signal is 50 percent. Those skilled in the art will appreciate that different lamp combinations and maximum, intermediate, and minimum points can be selected as desired for a particular application. In one embodiment, the first lamp and the second lamp have different light outputs.

When the dimming signal is greater than a predetermined dimming signal in Region I, the power converter controls the first lamp power between a minimum first lamp power and a maximum first lamp power in response to the dimming signal as illustrated by first lamp trace 320. The power converter sets the second lamp power to off as illustrated by second lamp trace 330.

When the dimming signal is less than the predetermined dimming signal in Region II, the power converter controls the first lamp power between an intermediate first lamp power and the maximum first lamp power in response to the dimming signal as illustrated by first lamp trace 324. The dimming control signal controls the second lamp power between an intermediate second lamp power and a maximum second lamp power in response to the dimming signal as illustrated by second lamp trace 334.

The first lamp and the second lamp make a complementary transition at the predetermined dimming signal between Region I and Region II. When the dimming signal increases through the predetermined dimming signal, i.e., when the dimming signal increases to the left, the power converter ramps the first lamp power to the maximum first lamp power and ramps the second lamp power to a minimum second lamp power. When the dimming signal decreases through the predetermined dimming signal to the right, the power converter ramps the first lamp power to the intermediate first lamp power and ramps the second lamp power to the intermediate second lamp power. The first lamp power is illustrated by first lamp trace 322 and the second lamp power is illustrated by second lamp trace 332. The change of the first lamp power and second lamp power is balanced so the system light output remains constant and the change in lamps imperceptible to the human eye.

The power converter can turn off the second lamp when the second lamp power reaches the minimum second lamp power. In most lamp systems, the minimum second lamp power corresponds to a minimum dimming level, such as 5 percent light output. Because the first lamp is at the maximum first lamp power when the second lamp is switched off, the change in light output is barely perceptible.

The dimming system described also increases the operating range of the system lamp output. Most lamps have a minimum dimming level, such as 5 percent light output. A single lamp is only able to operate with a light output between 5 and 100 percent. In a two lamp system, each of the lamps having the same maximum light output and the same minimum dimming level, such as 5 percent light output, the system is able to operate with a system light output between 2.5 and 100 percent. Only a single lamp is energized at low system lamp output/high dimming signal (first lamp trace 322 in Region I), so the minimum system lamp output is one half the single lamp minimum dimming level.

While the embodiments of the invention disclosed herein are presently considered to be preferred, various changes and modifications can be made without departing from the scope of the invention. The scope of the invention is indicated in the appended claims, and all changes that come within the meaning and range of equivalents are intended to be embraced therein.

The invention claimed is:

1. An electronic ballast dimming circuit receiving an analog dimming signal, the electronic ballast dimming circuit comprising:

an input dimming circuit operable to receive the analog dimming signal at an analog dimming signal input; and an output dimming circuit operably connected to the input dimming circuit, the output dimming circuit being operable to receive a fixed frequency signal having a variable duty cycle and to generate an analog dimming control signal in response to the analog dimming signal;

a dimmer operably connected to the analog dimming signal input through a switch when said switch is closed;

wherein output voltage at the analog dimming signal input is a function of the variable duty cycle of the fixed frequency signal when said switch is open and the analog dimming signal is not present at the analog dimming signal input.

2. The electronic ballast dimming circuit of claim 1 wherein the output dimming circuit is operably connected to the input dimming circuit through an isolation transformer.

3. The electronic ballast dimming circuit of claim 1 further comprising a microcontroller operable to generate the fixed frequency signal.

4. The electronic ballast dimming circuit of claim 1 wherein a discrete voltage level the output voltage corresponds to particular electronic ballast information.

5. The electronic ballast dimming circuit of claim 1 wherein the output voltage is serially encoded electronic ballast information.

6. The electronic ballast dimming circuit of claim 1 further comprising:

a microcontroller operable to receive the analog dimming control signal and to generate a power converter control signal; and a power converter operable to receive the power converter control signal and to provide lamp power.

7. The electronic ballast dimming circuit of claim 1 wherein the power converter is further operable to provide a power converter information signal to the microcontroller.

8. The electronic ballast dimming circuit of claim 1 further comprising a sensor operably connected to the analog dimming signal input to measure the output voltage at the analog dimming signal input.

9. An electronic ballast operably connected to a first lamp and a second lamp, the electronic ballast comprising:

a control circuit operable to receive a dimming signal and to generate a power converter control signal; and a power converter operable to receive the power converter control signal and to simultaneously provide first lamp power to the first lamp and second lamp power to the second lamp;

wherein, when the dimming signal is greater than a predetermined dimming signal, the power converter controls the first lamp power between a minimum first lamp power and a maximum first lamp power in response to the dimming signal, and the power converter sets the second lamp power to off; and when the dimming signal is less than the predetermined dimming signal, the power converter controls the first lamp power between an intermediate first lamp power and the maximum first lamp power in response to the dimming signal, and the dimming control signal controls the second lamp power between an intermediate second lamp power and a maximum second lamp power in response to the dimming signal.

10. The electronic ballast of claim 9 wherein:

when the dimming signal increases through the predetermined dimming signal, the power converter ramps the first lamp power to the maximum first lamp power and ramps the second lamp power to a minimum second lamp power; and when the dimming signal decreases through the predetermined dimming signal, the power converter ramps the first lamp power to the intermediate first lamp power and ramps the second lamp power to the intermediate second lamp power.

11. The electronic ballast of claim 10 wherein the power converter turns off the second lamp when the second lamp power reaches the minimum second lamp power.

12. The electronic ballast of claim 9 wherein the dimming signal is an analog dimming signal, and the control circuit comprises:

an input dimming circuit operable to receive the analog dimming signal at an analog dimming signal input;

an output dimming circuit operably connected to the input dimming circuit, the output dimming circuit being operable to receive a fixed frequency signal having a variable duty cycle and to generate an analog dimming control signal in response to the analog dimming signal; and a microcontroller operable to receive the analog dimming control signal and to generate the power converter control signal;

wherein output voltage at the analog dimming signal input is a function of the variable duty cycle of the fixed frequency signal when the analog dimming signal is not present at the analog dimming signal input.

13. The electronic ballast of claim 12 wherein the output dimming circuit is operably connected to the input dimming circuit through an isolation transformer.

14. The electronic ballast of claim 9 wherein the first lamp has a lamp filament, the power converter is responsive to the power converter control signal to provide filament power to the lamp filament, and the control circuit comprises:

a microcontroller operable to receive a communication signal and to generate the power converter control signal; and a memory operably connected to the microcontroller, the memory being operable to store a plurality of filament heating profiles;

wherein the microcontroller selects one of the plurality of filament heating profiles from the memory and controls the power converter control signal in accordance with the selected one of the plurality of filament heating profiles.

15. An electronic ballast operably connected to a lamp having a lamp filament, the electronic ballast comprising:

a microcontroller operable to receive a communication signal and to generate a power converter control signal;

a memory operably connected to the microcontroller, the memory being operable to store a plurality of filament heating profiles; and a power converter responsive to the power converter control signal to provide filament power to the lamp filament;

wherein the microcontroller selects one of the plurality of filament heating profiles from the memory and controls the power converter control signal in accordance with the selected one of the plurality of filament heating profiles.

16. The electronic ballast of claim 15 wherein the microcontroller selects a default filament heating profile absent other instructions.

17. The electronic ballast of claim 15 wherein the microcontroller selects a default filament heating profile each time the microcontroller powers up.

18. The electronic ballast of claim 15 wherein the microcontroller selects a most recently used filament heating profile each time the microcontroller powers up.

19. The electronic ballast of claim 15 wherein the filament heating profiles are selected from the group consisting of lamp life filament heating profiles and an efficiency filament heating profiles.

20. The electronic ballast of claim 15 wherein the electronic ballast receives an analog dimming signal, the electronic ballast further comprising:

an input dimming circuit operable to receive the analog dimming signal at an analog dimming signal input; and an output dimming circuit operably connected to the input dimming circuit, the output dimming circuit being operable to receive a fixed frequency signal having a variable duty cycle and to generate an analog dimming control signal in response to the analog dimming signal;

wherein output voltage at the analog dimming signal input is a function of the variable duty cycle of the fixed frequency signal when the analog dimming signal is not present at the analog dimming signal input.

21. The electronic ballast of claim 20 wherein the output dimming circuit is operably connected to the input dimming circuit through an isolation transformer.

22. The electronic ballast of claim 15 wherein the lamp is a first lamp and the electronic ballast is further operably connected to a second lamp, the power converter is operable to provide first lamp power to the first lamp and second lamp power to the second lamp, the electronic ballast further comprising:

a dimming circuit operable to receive a dimming signal and to provide a dimming control signal to the microcontroller;

wherein, when the dimming signal is greater than a predetermined dimming signal, the power converter controls the first lamp power between a minimum first lamp power and a maximum first lamp power in response to the dimming signal, and the power converter sets the second lamp power to off; and when the dimming signal is less than the predetermined dimming signal, the power converter controls the first lamp power between an intermediate first lamp power and the maximum first lamp power in response to the dimming signal, and the dimming control signal controls the second lamp power between an intermediate second lamp power and a maximum second lamp power in response to the dimming signal.

* * * * *